US006565036B1

(12) United States Patent
Palathingal et al.

(10) Patent No.: US 6,565,036 B1
(45) Date of Patent: May 20, 2003

(54) TECHNIQUE FOR IMPROVING ACCURACY OF HIGH SPEED PROJECTILES

(75) Inventors: Mohan J. Palathingal, Oradell, NJ (US); John C. Grau, Sussex, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/041,993

(22) Filed: Jan. 8, 2002

Related U.S. Application Data

(60) Provisional application No. 60/283,414, filed on Apr. 12, 2001.

(51) Int. Cl.[7] ..... F41G 7/26; F42B 10/28; F42B 15/01

(52) U.S. Cl. ..... 244/3.16; 244/3.17; 244/3.22; 102/213

(58) Field of Search ..... 244/3.16, 3.22, 244/3.17; 102/213

(56) References Cited

U.S. PATENT DOCUMENTS

| | | | | | |
|---|---|---|---|---|---|
| 4,234,145 | A | * | 11/1980 | Leiboff | 244/3.16 |
| 4,384,690 | A | * | 5/1983 | Brodersen | 244/3.22 |
| 4,408,735 | A | * | 10/1983 | Metz | 244/3.22 |
| 4,776,274 | A | * | 10/1988 | Kriz et al. | 102/213 |
| 5,456,425 | A | * | 10/1995 | Morris et al. | 244/3.22 |
| 6,076,765 | A | * | 6/2000 | Horwath | 244/3.16 |
| 6,138,945 | A | * | 10/2000 | Biggers et al. | 244/3.22 |
| 6,273,362 | B1 | * | 8/2001 | Fisch et al. | 244/3.16 |
| 6,343,766 | B1 | * | 2/2002 | Livingston | 244/3.13 |
| 6,356,396 | B1 | * | 3/2002 | Chen et al. | 244/3.17 |
| 6,507,392 | B1 | * | 1/2003 | Richards et al. | 244/3.16 |

* cited by examiner

*Primary Examiner*—Peter A. Nelson
(74) *Attorney, Agent, or Firm*—Michael C. Sachs; John F. Moran

(57) ABSTRACT

A system for guiding projectiles to a target. More particularly, a system for the guidance of projectiles toward a target using a photo detector array (18) and an arrangement of single use thrusters (22). The system is capable of guiding projectile to targets after firing from extended distances.

27 Claims, 2 Drawing Sheets

TECHNIQUE FOR IMPROVING ACCURACY OF HIGH SPEED PROJECTILES

This application claims the benefit of provisional application Ser. No. 60/283,414 filed Apr. 12, 2001.

U.S. GOVERNMENT INTEREST

The inventions described herein may be manufactured, used and licensed by or for the U.S. Government for U.S. Government purposes.

BACKGROUND OF THE INVENTION

1. Field of the Invention

The invention relates to a system for guiding projectiles to a target. More particularly, the invention relates to a system for the long range guidance of projectiles to a target without the complexity of fully guided munitions.

2. Description of the Related Art

The effectiveness of gun launched projectiles is directly related to the accuracy with which they can be delivered to the target. Over the years, numerous advancements have been made to gun systems that have greatly improved the accuracy with which projectiles can be delivered to the target. Among these advancements are aerodynamically stable projectiles, guns with longer barrels, improved barrel straightness, tighter tolerances on gun-projectile interface, higher muzzle velocities, and improved sighting and fire control systems. Although these efforts have significantly improved targeting accuracy, there is constant need in the military for increased effectiveness in delivery accuracy. This need and desire for high delivery accuracy led to the development of fully guided munitions. Fully guided munitions utilize various seekers coupled to some type of trajectory divert system (control fins, thrusters) through a closed loop control system to continuously track and maneuver toward the target.

Two categories of guided munitions systems are generally known in the art, autonomous and command guided weapons. Autonomous guided weapons generally contain control thrusters, attitude sensors, optical and/or radar based target sensors, hardware and software to accomplish target tracking, and projectile control processors for making guidance computations. Such known autonomous guided weapons include The Maverick, Stinger and Advanced Medium Range Air-To-Air Missile (AMRAAM).

Known command guided systems involve more control by an operator than automated systems. These systems generally use optical sensors or radar to image targets toward which an operator will lead the weapon. Weapons of this type, such as a Tube-launched Optically tracked, Wire guided (TOW) missile, typically carry an attitude reference gyro to define body roll position and an aerodynamic tail control system. Further, U.S. Patriot missiles are known to use attitude reference systems to cause commanded maneuvers to occur in the commanded direction. Further description of automated and command guided weapons systems can be found, for example, in U.S. Pat. No. 5,685,504.

While fully guided projectiles such as these offer the possibility of pinpoint accuracy at extended ranges they suffer from a number of disadvantages relative to unguided projectiles. Maneuvering all the way to the target requires large divert capability which leads to large interior volume requirements. Large rounds tend to have low muzzle velocity and high drag which, may lead to a need for an on board propulsion system in order to achieve acceptable terminal ballistic performance. Also, complex navigation systems employing autopilots and inertial measurement units may be needed. All of these systems tend to be costly and have survivability issues in the high acceleration gun launch environment. Fully guided projectiles are also difficult to develop and tend to be very costly relative to unguided ammunition. Accordingly, it is desirable to have projectiles with improved accuracy relative to unguided rounds without the complexity of a fully guided projectile. The present invention provides a solution to this need.

The present invention provides a system for the long range guidance of projectiles to a target utilizing a photo detector array and an arrangement of single use thrusters. The system is used to make small trajectory corrections at long ranges from targets such that only minimal maneuvering is required. This allows for minimizing of the size of the guidance system components and an overall reduction of the projectile size as compared to fully guided munitions.

SUMMARY OF THE INVENTION

The invention provides a guided projectile comprising:

a) a long rod penetrator body having a front end and a back end;

b) a detachable nose cone attached to the front end of the body;

c) a lens positioned within and at the front end of the body behind the nose cone;

d) a photo detector array positioned within and at the front end of the body behind the lens, said photo detector array comprising a plurality of circumferential and radial sectors and a central inactive region, said circumferential and radial sectors intersecting one another to form a grid around the central inactive region, the grid comprising a plurality of light sensitive grid regions;

e) a microprocessor positioned within the body and electrically connected to the photo detector array; and f) a thruster array coupled with the body, positioned to impart a thrust away from the body, and electrically connected to the microprocessor.

The invention also provides a process for guiding projectiles comprising:

A) firing a projectile toward a target, said projectile comprising:

i) a long rod penetrator body having a front end and a back end;

ii) a detachable nose cone attached to the front end of the body;

iii) a lens positioned within and at the front end of the body behind the nose cone;

iv) a photo detector array positioned within and at the front end of the body behind the lens, said photo detector array comprising a plurality of circumferential and radial sectors and a central inactive region, said circumferential and radial sectors intersecting one another to form a grid around the central inactive region, the grid comprising a plurality of light sensitive grid regions;

v) a microprocessor positioned within the body and electrically connected to the photo detector array; and vi) a thruster array coupled with the body at an outsider surface thereof, and electrically connected to the microprocessor, each thruster being positioned to impart a thrust away from the body;

B) removing the nose cone from the body, revealing the photo detector array;

C) aiming a laser at a target, said laser being reflected from the target toward the lens, the lens projecting an image from the laser onto at least one light sensitive grid region of the photo detector array; and D) transmitting a signal from said at least one light sensitive grid region to the microprocessor corresponding to the grid region; and optionally E) firing said thrusters in a sequence determined by said microprocessor which is sufficient to guide the projectile to the target.

DETAILED DESCRIPTION OF THE PREFERRED EMBODIMENTS

The invention generally provides a guided projectile with a guidance system having fewer and smaller component parts than fully guided projectiles.

Figure 1:
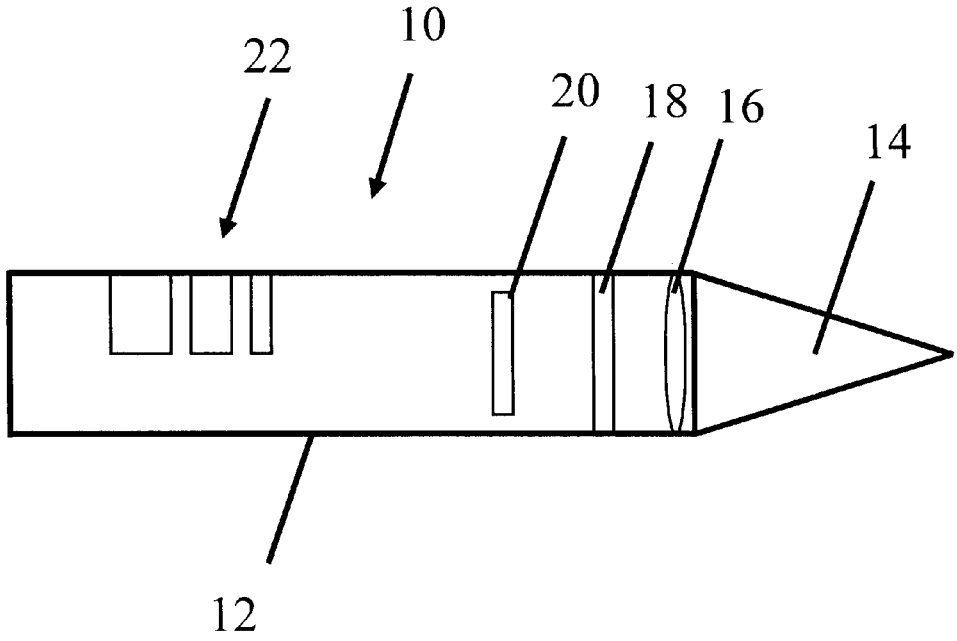
FIG. 1 is a schematic representation of a guided projectile of the present invention.

The guided projectile 10 of the invention comprises a cylindrical body 12 which has a front end and a back end, as illustrated in FIG. 1. The body 12 may non-exclusively comprise any type of axisymmetric long rod penetrator, such as a kinetic energy penetrator, a high explosive warhead, explosively formed warheads or a fragmenting metallic shell as taught, for example, in U.S. Pat. No. 6,135,028 which is incorporated herein by reference.

At the front end is attached a detachable nose cone 14. The nose cone 14 preferably comprises the same metal as the body 12. In the preferred embodiment of the invention, the nose cone 14 is attached to the body 12 such that it may be detached or blown off in flight using mechanical means, such as a compressed spring, a lever or other device capable of storing kinetic energy, with conventional explosives, or a propellant. In order to conduct this step it is necessary to plant a suitable explosive material, such as Winchester 745 powder, at the interface where the nose cone 14 and the body 12 meet (not shown). The nose cone 14 is detached at a preset time that is transmitted to the projectile prior to launch or via an externally controlled signal using conventionally known techniques as may be determined by one skilled in the art.

Figure 2:
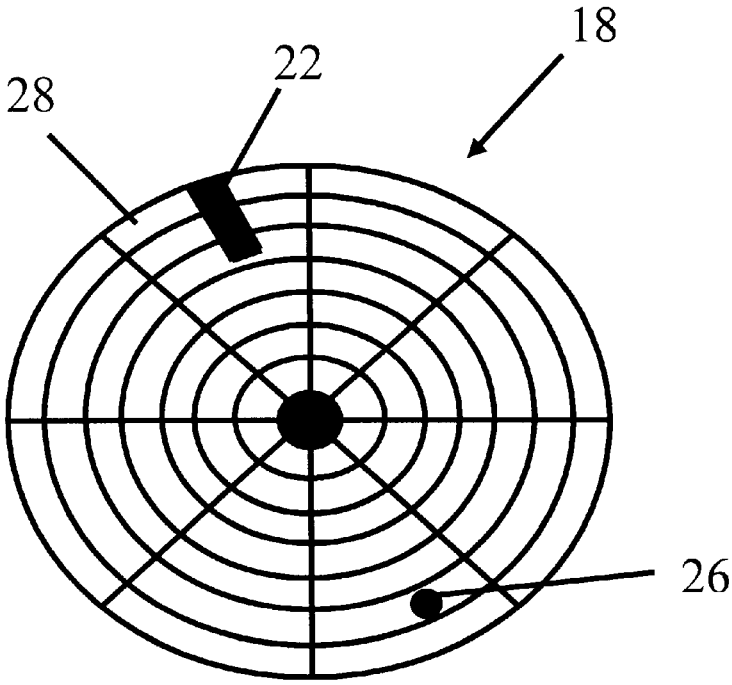
FIG. 2 is a schematic representation of a projected image on a photo detector array and also showing a thruster array behind the photo detector array.

Positioned within the body 12 and at the front end directly behind the nose is a lens 16. The lens is capable of focusing light reflected toward it from a target to a photo detector array 18 which is positioned within the body 12 at the front end behind the lens. The photo detector array 18 comprises a plurality of circumferential sectors, each having a plurality of radial sectors, and a central inactive region, as illustrated in FIG. 2. As seen in the figure, these circumferential and radial sectors intersect one another to form a grid around the central inactive region, the grid comprising a plurality of light sensitive grid regions 28. Each of these light sensitive grid regions 28 are sensitive to light in both of the visible and infrared wavelengths of the electromagnetic spectrum, except for the central inactive region. In the preferred embodiment of the invention, the photo detector array comprises about seven circumferential sectors, each having about eight radial sectors, forming a grid having fifty-six light sensitive grid regions 28.

In use, the projectile is fired from a vessel toward a target. In order to guide the projectile to the target after firing, a light beam is reflected off the target and back to the in-flight projectile 10. The source of the light beam may originate from a passive or active system. When appropriate, a passively controlled light source may comprise a laser beam emitted from a device controlled by a ground soldier or by military equipment such a tank. Alternatively, when the target is located at very long distances from the projectile, an active system incorporating a light seeker on the projectile may be more appropriate. The detection system may also be designed to operate in an infra red mode, the target being the source of the infra red radiation.

Initially, the nose cone 14 serves as a windshield that protects the lens 16 from the outer elements until the detection event. This also reduces any imaging errors causes by diffraction and refraction of the light source through the oblique shock wave caused at high projectile those velocities. Once the nose cone 14 is blown off, the light beam is able to reach and pass through the lens 16. The lens 16 then focuses an image from the light beam onto the grid of the photo detector array 18 positioned behind the lens 16. If the lens 16 projects the light beam image onto the central inactive region of the grid, then it is determined that the projectile is on a direct course to impact the target, and its trajectory does not need to be altered. However, if the light beam is projected onto one of the light sensitive grid regions 28, then it is determined that the projectile is off course and its trajectory must be corrected to hit its target. The concept relies on the fact that at the time of the target sensing, the projectile is pointed at the direction in which its trajectory is headed. Projectile yaw and trajectory curvature would cause the nose to point in a direction other than it is headed. Therefore the sensing should be delayed to allow the initial yawing to damp out to minimize the trajectory curvature errors by allowing the projectile to pass the target apogee. The sizing of the central inactive region would be such that it would encompass the above said errors.

As seen in each of FIGS. 1 and 2, the trajectory of the projectile 10 may be altered by firing one or more thrusters of a thruster array 22 which is coupled with the body 12. The thruster array 22 is positioned to impart a thrust away from the body and is electrically connected to a microprocessor 20. The thruster array may comprise various suitable arrangements. In the preferred embodiments of the invention, the thruster array 22 comprises either a linear or a radial array of thrusters. The most preferred thruster embodiment of the invention is a three thruster array as is illustrated in FIG. 1 wherein each thruster is of a different size and thrust force than each of the other thrusters of the array. In particular, the second thruster shown in this embodiment is capable of exerting twice the thrust level of the first thruster shown, and the third thruster shown is capable of exerting twice the thrust level of the second thruster. Each of these thrusters are capable of being fired either individually or together in any combination.

When a combination of the thrusters are fired to achieve the desired thrust level, they are fired simultaneously. This will cause the combined forces of the thrusters to guide projectile exactly as computed by the microprocessor 20. Furthermore, the preferred thrusters for use in the invention are single-use thrusters that are only capable of being fired once.

Figure 3:
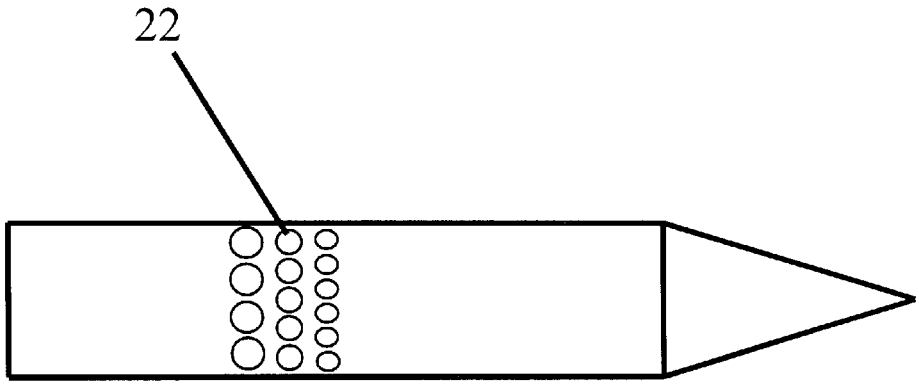
FIG. 3 is a side-view schematic representation of a projectile having multiple radial rings of thrusters mounted on its side.

The scope of the invention is not limited to the three component linear thruster array as shown in FIG. 1. The thruster array may comprise a radial array of thrusters around a circumference of the projectile body 12, as shown in FIG. 3. Each of these thrusters may be substantially identical in size or may vary in size, which may be determined by one skilled in the art. FIG. 3 illustrates an example of a thruster array having multiple rings of thrusters around the projectile body wherein the particular thrusters in each ring exert the same impulse, but each ring comprises thrusters of different impulses. In the preferred embodiment of the invention, the thrusters are located within the body 12 just under the body surface. The thruster array 22 or each individual thruster is preferably covered by a releasable plug that pops off the body 12 immediately upon firing of the thrusters. The thrusters may also be positioned on the outer surface of the body 12, but this is not preferred.

The firing of the thrusters is directly controlled by microprocessor 20, which can be seen in FIG. 1. The microprocessor 20 is positioned within the body 12 and is electrically connected to the photo detector array 18 and to the thrusters 22. The microprocessor 20 is also electrically connected to a means for removing the nose cone 14. Said means preferably comprises explosives which are well know in the art, the explosives being ignited in response to a signal from the microprocessor 20. Each of the light sensitive grid regions 28 are also electrically connected to the microprocessor 20.

The particular grid region 28 that a light beam image is projected onto will determine the combination and timing with which the thrusters are fired, with the goal of moving the projected image into the center circle, as seen in FIG. 2. Once the image is set at the central inactive region, the trajectory of the projectile is set directly at the intended target. To illustrate, a light beam is projected toward a target and reflected from the target toward the in flight projectile 10. Once the nose cone is blown off, the light beam is projected onto the revealed lens 16 and a light beam image is then projected onto the photo detector array 18. Subsequently, a digital signal is transmitted from the array 18, via an electrical connection, to the microprocessor 20, communicating to the microprocessor 20 the location of the image on the grid. If the light beam image falls directly into one of the grid regions, the exact location will be electrically transmitted to the microprocessor 20. If the light beam image happens to overlap on more than one region, the region receiving the highest light intensity will determine the signal to the microprocessor 20.

The time to fire the thrusters is directly related to the angular difference between the location of the illuminated grid region to that of the body fixed thruster array. However, to determine the time to fire the thrusters, it is necessary that the spin rate of the projectile be preprogrammed into the microprocessor. Alternatively, a spin rate sensor could be connected to the projectile body 12 and the microprocessor 20 to measure the spin rate of the projectile. Depending on which radial sector the image falls into, the microprocessor will allow the projectile to spin for the time necessary for the thrusters to be aligned in the appropriate direction for firing, generally opposite the location of the image on the grid (see FIG. 2). Once the thrusters are opposite the image, the thrusters are then fired at an intensity determined by the circumferential sector the image falls into. Particularly, the further from the center of the photo detector array that the image is, the stronger the thrust must be to guide the projectile to the target. This information corresponding to each grid region is pre-programmed into the microprocessor 20, and a simple digital correlation is made by the radial location or distance of the illuminated grid region from the central inactive region to the desired thrust level. If the thrusters are properly fired at the correct timing, the projected image from the target to the photo detector array 18 will ultimately move from a grid region 28 into the center of the array 18, indicating that the projectile 10 is now on direct course with the target.

In another alternate embodiment of the invention, if rings of thrusters are used the spin rate is irrelevant because the microprocessor 20 could compute which thrusters along the projectile body 12 to fire immediately after the light beam is projected onto the photo detector array 18. In this embodiment, all of the thrusters in a particular ring are not fired. Rather, one thruster or a combination of thrusters from each ring of thrusters at a desired location on the projectile 10, are fired to guide the projectile onto direct course with the target.

In yet another embodiment, a pair of lateral accelerometers could be mounted along the central axis of the projectile to verify that the projectile has low yaw at the time of sensing the orientation of the projectile 10 to the target.

In addition, to work properly, the guiding system requires the selection of the minimum range to the target ($R_{min}$) for which the trajectory guidance system may be used, and the offset range from the target ($R_{offset}$) at which the trajectory guidance system would be initiated. The $R_{min}$ value would be selected based on the probability that the projectile would hit the target without trajectory correction and the aerodynamic damping characteristics of the projectile. For example, $R_{min}$ must be large enough such that the yaw level at the minimum initiation range ($R_{min}$–$R_{offset}$) of the projectile with the target has damped sufficiently to allow the light beam seeker to properly reflect from the target to the projectile. However, $R_{min}$ must be small enough such that when the projectile is fired from a distance of less than $R_{min}$ from the target that the hit probability is acceptable without trajectory correction. Likewise, $R_{offset}$ must be carefully selected because the system is only able to correct for trajectory errors accumulated up to initiation of the system. Any flight errors occurring after the thrusters 22 are fired may impair the likelihood of impact with the target. In other words, the projectile must be fired from a distance far enough from the target to allow enough time for the system to correct any trajectory errors. If below $R_{min}$, the projectile should only be fired if it is capable of hitting the target without correction. Similarly, the projectile must be fired from a location such that it is laterally offset by a distance small enough such that sufficient time is allowed for correction of the trajectory prior to reaching the target area, yet not enough time to allow for additional projectile displacement, such as displacement due to unexpected atmospheric conditions.

The following example serves to illustrate the invention.

EXAMPLE

A projectile is fired from a airborne vessel toward a target at a range of 3000 meters, and having an $R_{min}$ value of 1500 meters and an $R_{offset}$ value of 500 meters. The projectile is launched and the nose cone is blown off using a Winchester 745 powder charge, revealing the lens behind the nose cone. A light beam is projected from a ground vessel toward the target and reflected to the lens. An image is focused from the lens onto the photo detector array grid. The microprocessor determines that all three thrusters (0.441 lbs. force/second, 0.882 lbs. force/second, 1.764 lbs. force/second) must be fired to correct the trajectory of the projectile. The projectile spins to the proper orientation, the thrusters are fired, and seconds later the projectile hits the target.

What is claimed is:

1. A guided projectile comprising:

a) a long rod penetrator body having a front end and a back end;

b) a detachable nose cone attached to the front end of the body;

c) a lens positioned within and at the front end of the body behind the nose cone;

d) a photo detector array positioned within and at the front end of the body behind the lens, said photo detector array comprising a plurality of circumferential and radial sectors and a central inactive region, said circumferential and radial sectors intersecting one another to form a grid around the central inactive region, the grid comprising a plurality of light sensitive grid regions;

e) a microprocessor positioned within the body and electrically connected to the photo detector array; and f) a thruster array coupled with the body, positioned to impart a thrust away from the body, and electrically connected to the microprocessor.

2. The guided projectile of claim 1 wherein each of said grid regions are independently connected to the microprocessor.

3. The guided projectile of claim 1 wherein said thruster array comprises a linear array of thrusters.

4. The guided projectile of claim 1 wherein said thruster array comprises a radial array of thrusters around a circumference of the body.

5. The guided projectile of claim 1 wherein said thruster array comprises a linear array of thrusters and each thruster of said thruster array is of a different size than another thruster of said thruster array.

6. The guided projectile of claim 1 wherein the thruster array comprises a linear array comprising at least first, second and third thrusters, wherein said second thruster is capable of exerting twice the thrust level of the first thruster, and the third thruster is capable of exerting twice the thrust level of the second thruster.

7. The guided projectile of claim 1 wherein said thruster array comprises a radial array of thrusters comprising multiple rings of thrusters wherein each ring comprises different thrusters and each of the thrusters within a ring are substantially identical to one another.

8. The guided projectile of claim 1 wherein said thrusters are positioned within the projectile body.

9. The guided projectile of claim 1 wherein said thrusters are positioned on an outer surface of the projectile body.

10. The guided projectile of claim 1 wherein said thrusters comprise single-use thrusters.

11. The guided projectile of claim 1 wherein said microprocessor is electrically connected to means for removing the nose cone.

12. The guided projectile of claim 1 wherein said photo detector array comprises at least 7 circumferential sectors, each having at least 8 radial sectors.

13. A process for guiding projectiles comprising:

A) firing a projectile toward a target, said projectile comprising:

i) a long rod penetrator body having a front end and a back end;

ii) a detachable nose cone attached to the front end of the body;

iii) a lens positioned within and at the front end of the body behind the nose cone;

iv) a photo detector array positioned within and at the front end of the body behind the lens, said photo detector array comprising a plurality of circumferential and radial sectors and a central inactive region, said circumferential and radial sectors intersecting one another to form a grid around the central inactive region, the grid comprising a plurality of light sensitive grid regions;

v) a microprocessor positioned within the body and electrically connected to the photo detector array; and vi) a thruster array coupled with the body at an outsider surface thereof, and electrically connected to the microprocessor, each thruster being positioned to impart a thrust away from the body;

B) removing the nose cone from the body, revealing the photo detector array;

C) aiming a laser at a target, said laser being reflected from the target toward the lens, the lens projecting an image from the laser onto at least one light sensitive grid region of the photo detector array; and D) transmitting a signal from said at least one light sensitive grid region to the microprocessor corresponding to the grid region.

14. The process of claim 13 further comprising:

E) firing said thrusters in a sequence determined by said microprocessor which is sufficient to guide the projectile to the target.

15. The process of claim 13 comprising removing the nose from the body by blowing it off with explosives, a propellant, or by removing it mechanically.

16. The process of claim 13 wherein said laser image is projected onto the central inactive region of the photo detector array.

17. The process of claim 13 wherein said thruster array comprises a linear array of thrusters.

18. The process of claim 13 wherein said thruster array comprises a radial array of thrusters around a circumference of the body.

19. The process of claim 13 wherein the thruster array comprises a linear array comprising at least first, second and third thrusters, wherein said second thruster is capable of exerting twice the thrust level of the first thruster, and the third thruster is capable of exerting twice the thrust level of the second thruster.

20. The process of claim 13 wherein said thrusters are positioned within the projectile body.

21. The process of claim 13 wherein said thrusters are positioned on an outer surface of the projectile body.

22. The process of claim 13 wherein said thrusters comprise single-use thrusters.

23. The process of claim 13 wherein said photo detector array comprises at least 7 circumferential sectors, each having at least 8 radial sectors.

24. The process of claim 13 further comprising firing said thrusters in a sequence determined by said microprocessor to guide the projectile to the target, wherein each of said radial sectors determines the time when the thrusters are fired.

25. The process of claim 13 further comprising firing said thrusters in a sequence determined by said microprocessor to guide the projectile to the target, wherein each of said circumferential sectors determines which thrusters are fired.

26. The process of claim 14 comprising firing only one thruster.

27. The process of claim 14 comprising firing a plurality of thrusters simultaneously.

* * * * *